US005996881A

United States Patent [19]

Smith

[11] Patent Number: 5,996,881

[45] Date of Patent: Dec. 7, 1999

[54] CONVERTIBLE FOLDER

[76] Inventor: Brenton L. Smith, 710 East Lake Cowdry, Alexandria, Minn. 56308

[21] Appl. No.: 09/094,902

[22] Filed: Jun. 15, 1998

[51] Int. Cl.[6] ..... B65D 27/00; B42F 21/06; G09F 3/18

[52] U.S. Cl. ..... 229/67.1; 40/359; 40/641; 40/661

[58] Field of Search ..... 40/359, 661, 641; 229/67.1, 67.2, 67.3, 67.4

[56] References Cited

U.S. PATENT DOCUMENTS 1,372,265 9/1921 Bushnell ..... 40/359
3,933,294 1/1976 Meenan et al. ..... 229/67.3
4,053,057 10/1977 Snowden ..... 40/359
5,066,045 11/1991 Hawes, Jr. et al. ..... 40/359
5,503,487 4/1996 Ong ..... 40/359

*Primary Examiner*—Stephen P. Garbe

[57] ABSTRACT

A convertible folder is formed from a single blank and includes a pair of folder panels hingedly connected along a fold line. A pocket defining panel is folded against one of the folder panels and cooperates therewith to form a pocket for containing documents.

A small tab supporting panel is secured to and folded against the pocket defining panel in the preferred embodiment. An identifying tab is movably secured to the tab defining panel and is moveable between a display position and an out-of-the-way position to allow delivery/presentation folder to be readily converted to a conventional file folder.

5 Claims, 3 Drawing Sheets

CONVERTIBLE FOLDER

FIELD OF THE INVENTION

This invention relates to folders and more particularly to a convertible folder.

BACKGROUND OF THE INVENTION

Presentation materials in the form of promotional, advertising or informational documents are usually contained within a delivery/presentation folder. The size of these delivery/presentation folders corresponds to conventional file folders. In many instances, the persons receiving such delivery/presentation folders wish to retain the contents for ready reference and review. Since the size of the folders containing the contents corresponds to a file folder, only an identifying tab is required.

Attaching a tab to the delivery/presentation folder before such folders are mailed would be desirable but the tab would interfere with the folder fitting within a conventional envelope.

SUMMARY OF THE INVENTION

It is an object of this invention to provide a delivery/presentation folder with an identifying tab attached to the folder but which is readily movable from an out of the way position within the confines of a folder to a display position to thereby convert the delivery/presentation folder to a file folder.

In one embodiment of the invention, the identifying tab may be removed from a position within the folder and reattached in a display position. In another embodiment, the identifying tab is shiftable between a position within the folder to a displaying position. Finally, in a further embodiment, the display tab may be selectively positioned in any one of a plurality of positions along the folder.

DESCRIPTION OF THE PREFERRED EMBODIMENT

Figures 1, 2:
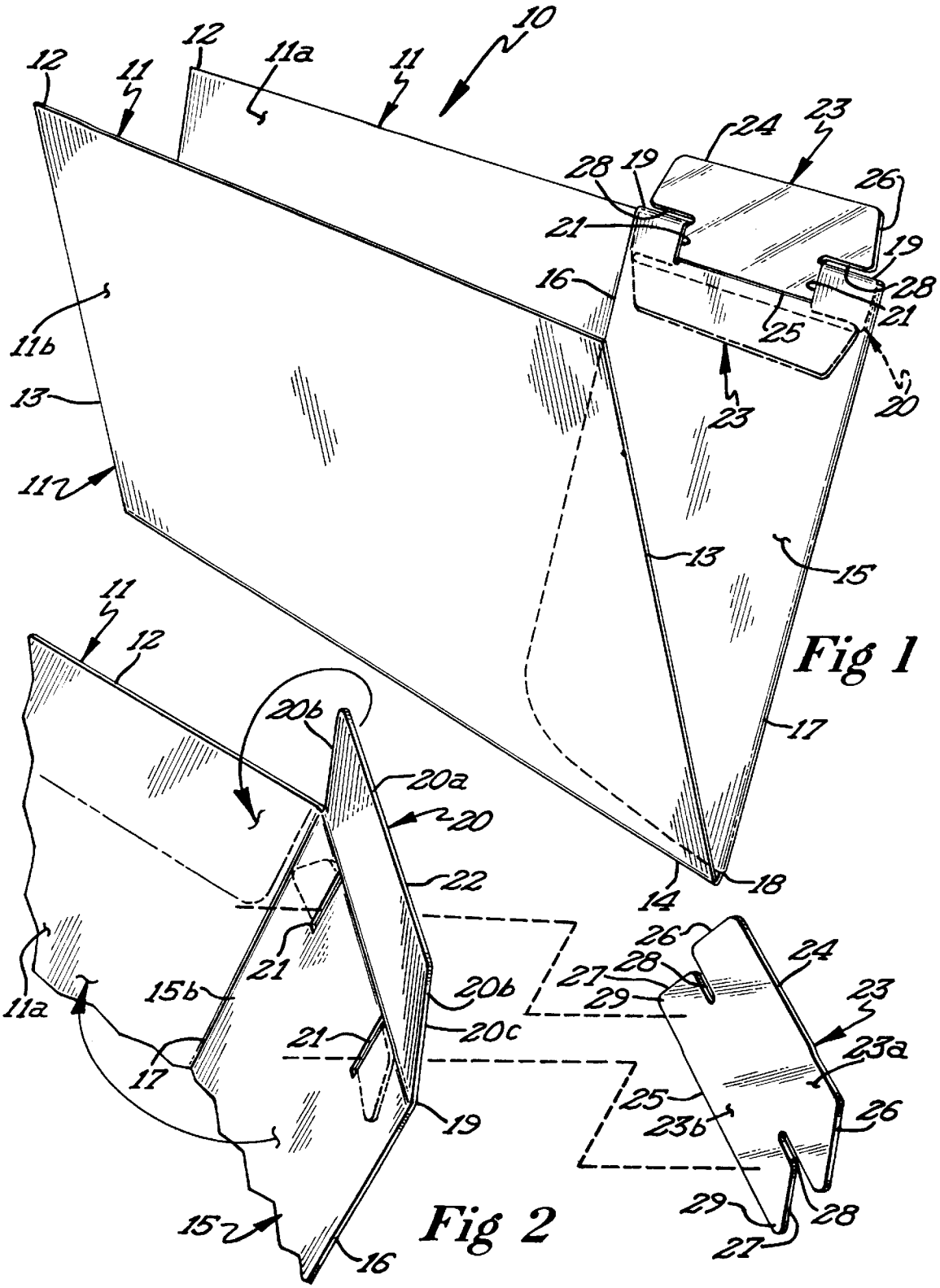
FIG. 1 is a perspective view of one embodiment of the deliver/presentation folder illustrating the tab in a display position in full line configuration and in a position within the folder in dotted line configuration.
FIG. 2 is an exploded perspective view of a portion of the folder illustrating details of construction of the various components thereof.

Referring now to FIGS. 1 and 2, it will be seen that one embodiment of the novel convertible folder, designated generally by the reference numeral 10, is thereshown. The folder 10 includes a pair of flat generally rectangular shaped substantially similar folder panels 11 formed from a single blank of tag board material, each panel including a longitudinal edge 12, transverse edges 13, an inner surface 11*a* and an outer surface 11*b*. The panels, being formed from a single blank, are secured together along a fold line 14 which defines a common longitudinal edge.

The convertible folder also includes a flat generally rectangular shaped pocket defining panel 15 which is connected to one of the folder panels 11 along a fold line 17 which defines a common edge between the folder panel and pocket defining panel. The pocket defining panel 15 also includes a longitudinal edge 16, and a transverse edge 18. The pocket defining panel 15 is also connected to a small generally rectangular shaped tab supporting panel 20 along a fold line 19. It will be noted that the pocket defining panel has a width dimension corresponding to the width dimension of a folder panel but has a length dimension corresponding to approximately one third the length of the folder panels.

When the pocket defining panel is folded upon and secured to one of the folder panels 11, the pocket panel cooperates with the folder panel to define a pocket 15*a* of well known construction for receiving documents therein which are contained by the convertible folder 10.

Again it will be noted that the folder panels, pocket defining panel and tab supporting panel are all formed from a single blank of tag board material. The tab supporting panel 20 has a substantially straight upper longitudinal edge 20*a* and a pair of substantially straight transverse edges 20*b*. It will be seen that the pocket defining panel 15 has a pair of elongate laterally spaced apart substantially parallel slots 21 therein which extend downwardly from the fold line 19.

When the convertible folder is formed, the tab supporting panel is folded down against the pocket defining panel and glue is applied to the exterior surface 20*c* of the tab supporting panel. The downwardly folded tab supporting panel and pocket defining panel are then folded against the adjacent folder panel 11 so that the glue on the outer surface 20*c* of the supporting panel engages the inner surface 11*a* of the adjacent folder panel. The pocket defining panel 15 is therefore secured via the tab supporting panel 20 to the inner surface of the folder panel along one marginal area.

The convertible folder 10 is also provided with an identifying tab 23 which is preferably of rigid single piece construction and is preferably formed of a suitable plastic, metal or similar rigid material. The tab has an upper longitudinal edge 24, a lower longitudinal edge 25, upper downwardly inclined transverse edges 26, and lower downwardly inclined transverse edges 27. A pair of aligned slots 28 extend inwardly from the transverse edges of the tab and serve to divide the tab into an upper display portion 23*a* and a lower anchor portion 23*b*.

The tab may have the identifying and descriptive information on the display portion 23*a*. However, when the convertible folder 10 is presented or delivered to the receiver, the identifying tab 23 will be disposed in the out-of-way position illustrated dotted line configuration of FIG. 1. In this position, the display portion 23*a* will be disposed downwardly and the anchor portion will have its outer ends inserted through the slots 21 in the pocket defining panel thereby securing the tab to the folder. In this regard, the outer ends 29 of the anchor portion define anchor elements which extend through the slots 21 to secure the tab to the folder.

If the receiver wishes to retain the folder and the contents thereof in the receiver's file, the identifying tab 23 is removed from the folder and reinserted in the display position as illustrated by full line configuration of FIG. 1. Since the folder is of conventional file folder size, the folder may be readily inserted into the receiver's files for use as a regular file folder. Thus the convertible folder 10 is readily convertible from a delivery/presentation folder to a conventional file folder by merely repositioning the identifying tab.

Figure 3:
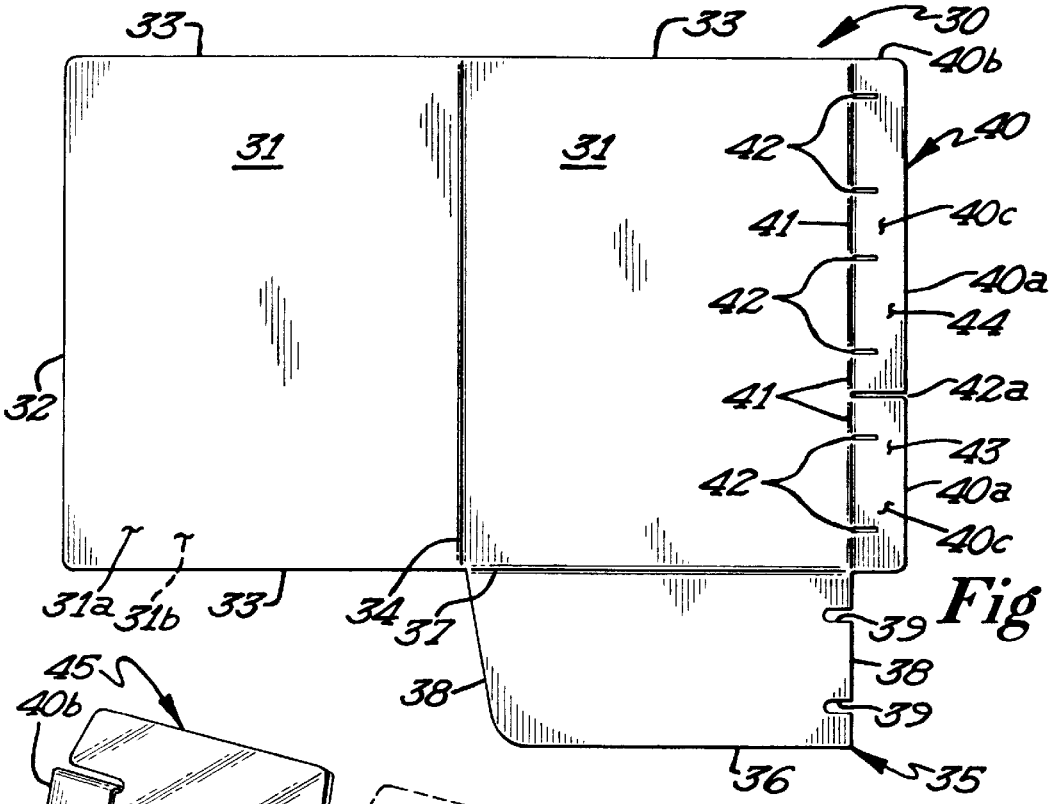
FIG. 3 is a plan view of a different embodiment of the folder blank prior to final assembly.
Figure 4:
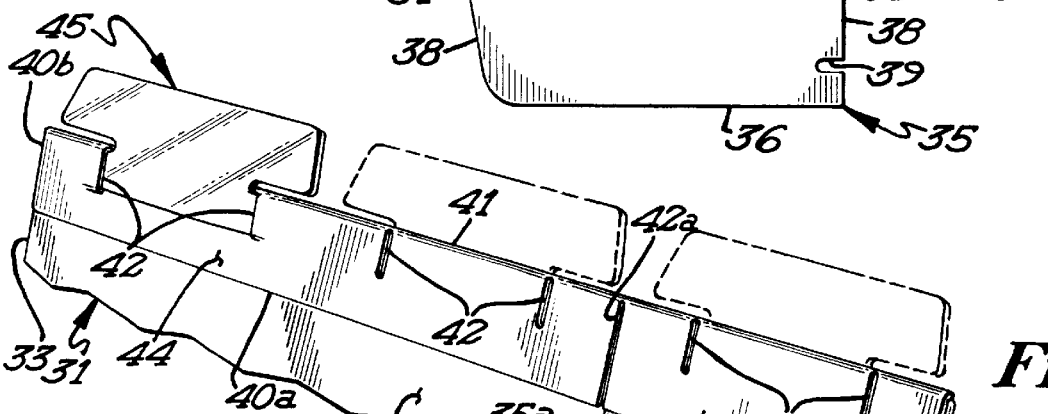
FIG. 4 is a fragmentary perspective view of a portion of the embodiment illustrated in FIG. 3 but showing the tab in full line configuration in one position and illustrating the tab in other positions by dotted line configurations.

Referring now to FIGS. 3 and 4, it will be seen that a second embodiment of the convertible folder, designated generally by the reference numeral 30, is thereshown. The convertible folder 30 is similar to the embodiment of FIGS. 1 and 2 and includes a pair of flat substantially rectangular folder panels 31, one panel having a longitudinal edge 32. The convertible folder is formed from a single blank and the folder panels have transverse edges 33 and are secured together along a fold line 34.

The folder 30 also includes a pocket defining panel 35 which is similar in configuration to the pocket defining panel of the embodiment of FIGS. 1 and 2. The pocket defining panel 35 has a longitudinal edge 36 and is secured to the associated folder panel 31 along a fold line 37. The fold line 37 defines a longitudinal edge of the pocket defining panel and also defines a transverse edge of the associated folder panel. Each of the folder panels has an inner surface 31*a* and an outer surface 31*b*. The pocket defining panel 35 also has transverse edges 38, one of which is slightly inclined to allow folding clearance when the pocket defining panel is folded against the folder panel. It will also be noted that the pocket defining panel 35 also has a pair of laterally spaced apart slots 39 therein which extend inwardly in from a transverse edge thereof.

An elongate rectangular shaped tab supporting panel 40 extends from one of the folder panels 31 and is secured thereto along a fold line 41. The tab supporting panel 40 has an upper longitudinal edge 40*a* and transverse edges 40*b*. The panel has an inner surface 40*c* and an outer surface 40*d*. A plurality of longitudinally spaced-apart, transversely extending, substantially parallel slots 42 are formed in the supporting panel 40 and extend outwardly from the fold line 41.

The tab supporting panel 40 is also provided with a relatively long slot 42*a* which extends from the fold line 41 outwardly through the upward longitudinal edge 40*a*. The slot 42*a* divides the tab supporting panel 40 into a small tab panel 43 and a relatively large tab panel 44. When the convertible folder 30 is formed from the blank, the inner surface of the large tab panel 44 has glue applied to the inner surface 40*c* and this large tab panel will be folded against and secured to the associated folder panel. Glue will be applied to the larger tab panel 44. The smaller tab panel 43 will have glue applied to the inner surface 40*c* thereof and the small tab panel will be folded downwardly and will be engaged by the inwardly folding pocket defining panel 35 to secure the latter to the associated folder and to define a pocket 35*a*. The longer slot 42*a* allows the pocket opening to extend to the fold line 41.

The convertible folder 30 is provided with a tab 45 which is identical in construction to the tab 23 of the embodiment of FIG. 1. The tab 45 will be moveable between a display position, as illustrated by dotted line configuration of FIG. 4, to an out-of-the-way position in the manner of the embodiments of FIGS. 1 and 2. The construction of the tab supporting panel 40 allows the tab to be selectively positioned longitudinally along a plurality of positions on the folder when in the display position. This allows a user to stagger the tabs for easier recognition of the identifying indicia on the tab.

Figure 5:
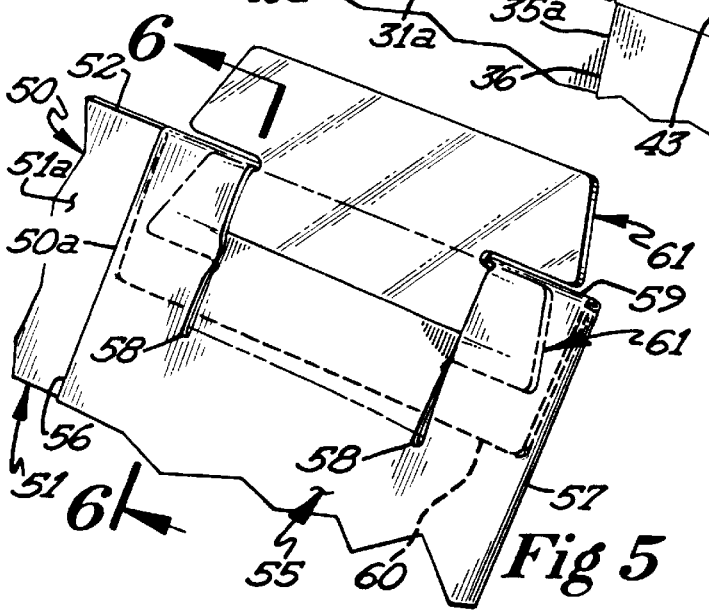
FIG. 5 is a fragmentary perspective view of another embodiment of the novel folder and tab.
Figure 6:
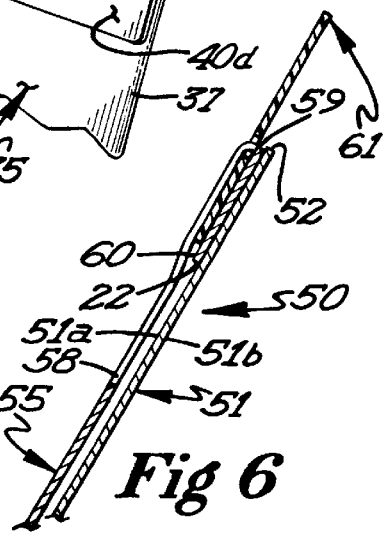
FIG. 6 is a cross-sectional view taken along lines 6—6 of FIG. 5 and looking in the direction of the arrows.

Referring now to FIGS. 5 and 6, it will be seen that a further embodiment of the novel convertible folder designated generally by the reference numeral 50, is thereshown. The convertible folder 50 formed from a single blank and including a pair of folder panels 51 interconnected by a fold line (not shown) in the manner of the embodiment of FIG. 1. Folder panels 51 have longitudinal and transverse edges in the manner of the embodiment of FIG. 1 including longitudinal edge 52. The folder also has a pocket defining panel 55 which is substantially similar in construction to the pocket defining panel of the embodiment of the FIGS. 1 and 2 and includes a longitudinal edge 56 as illustrated in FIG. 5. The pocket defining panel is secured to the associated folder panel along fold line 57.

The pocket defining panel 55 has a pair of elongate slots 58 therein and these slots have a greater length dimension than the slots 21 in the embodiment of FIGS. 1 and 2.

The convertible folder 50 also includes a generally rectangular shaped tab supporting panel 60 which is substantially identical to the tab supporting panel of FIGS. 1 and 2 and is secured to the pocket defining panel 55 along a fold line 59. When the convertible folder 50 is assembled, the tab supporting panel 60 will have glue applied to the outer surface thereof and the tab supporting panel will be folded downwardly against the pocket defining panel and the latter will be folded inwardly against the associated folder panel 51. The glue on the tab supporting panel will secure to the pocket defining panel and tab supporting panel to the associated folder panel and define the pocket 50*a* in the manner of the embodiments of FIGS. 1 and 2.

The convertible folder 50 also include a tab 61 which is substantially identical in construction and configuration to the embodiments of FIGS. 1 through 4 and includes an anchor portion and a display portion. The tab is moveable between a display position and an out of the way position by moving the tab downwardly or upwardly in the slots 58. It will be seen from FIG. 5 that when the tab is moved downwardly to the out-of-the-way position, the upper longitudinal edge of the tab will be positioned within the confines of the associated pocket defining flap. This arrangement allows the tab to be slid between the display and the out-of-the-way positions with respect to the associated folder.

Figure 7:
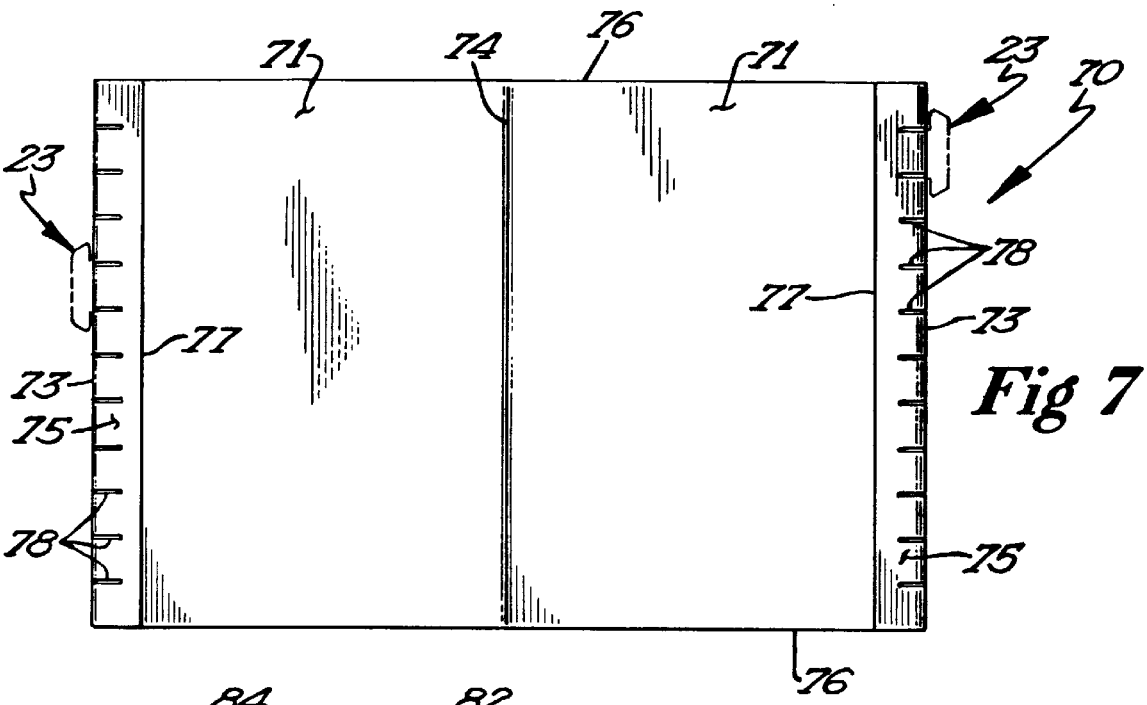
FIG. 7 is an elevational view of a different embodiment of a folder.

Referring now to FIG. 7, it will be seen that a different embodiment of the folder, designated generally by the reference numeral 70 is shown. The folder 70 is formed of the same material as the embodiments of FIGS. 1–6 and includes a pair of rectangular panels formed from a single blank of material. Each panel includes straight transverse edges 76 and a longitudinal edge 73. The panels 71 are hinged together along a fold line 74. Each panel also has a rectangular tab supporting panel 75 folded downwardly along a fold line defined by the longitudinal edge 73 of each panel. Each tab supporting panel also has opposed transverse edges 76 and a longitudinal edge 77 which is disposed parallel to the fold line defined by the longitudinal edge 73. The tab supporting panel 75 has a plurality of longitudinally spaced apart transversely extending slit 78 therein which are adapted to accommodate a tab 23 therein.

In the embodiment illustrated in FIG. 7, the folder is not provided with a pocket but each folder panel 71 is provided with a tab supporting panel 75 along one longitudinal edge thereof. Thus the folder depicted in FIG. 7 is a non-pocketed standard file folder often referred to as manila folders. The slots along the tab supporting panel permits the tab or tabs to be placed along one of several selected positions with respect to each folder panel. Many people prefer manila folder as a file container rather than the hanging folders. The embodiment of FIG. 7 allows manila folders to be used as convertible file folders with the added versatility of the permiting positioning of the tab in engaging relation with the tab supporting panel. The tabs are readily moveable between an out-of-the-way position (for shipping or delivery) and a display position.

Figure 8:
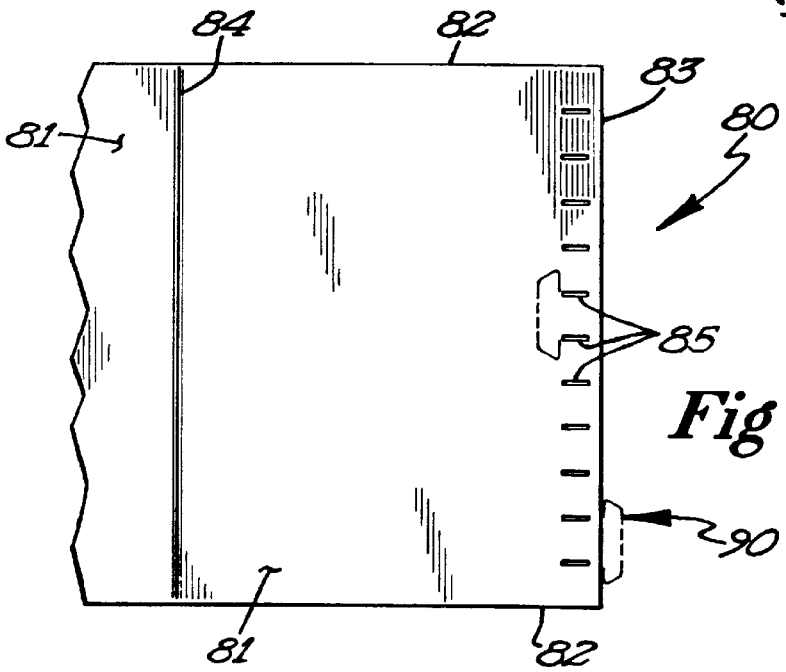
FIG. 8 is a fragmentary elevational view of a further embodiment of a folder; and, FIG. 9 is an elevational view of a different embodiment of the novel tab.

Referring now to FIG. 8, it will be seen that a further embodiment of the convertible folder designated generally by the reference numeral 80 is thereshown. The folder 80 is also of rectangular configuration and is formed from a single blank of material in the manner of the embodiment of FIGS. 1–7. The folder includes a pair of generally rectangular shaped panels 81 each having straight transverse edges 82 and a longitudinal edge 83. An edge portion of each panel adjacent the longitudinal edge 83 is provided with a plurality of longitudinal spaced apart transversely extending slits 85 therein. It is pointed out that the folder 80 illustrated in FIG. 8 may have slots in the longitudinal edge portion of one panel or the slots may be provided in both panels. The slits hold the tab in the manner of the embodiment of FIGS. 1–7. The embodiment illustrated in FIG. 8 is a further simplification of the manila folder depicted in FIG. 7. The particular tab which is used with the folder 80 is also illustrated in FIG. 9.

Figure 9:
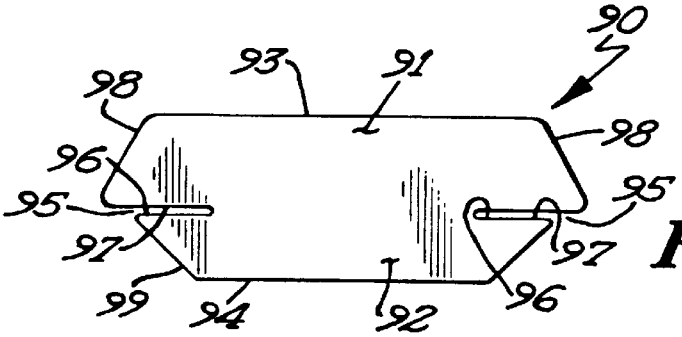

Referring now to FIG. 9, it will be seen that a different embodiment of the tab, designated generally by the reference numeral 90, is thereshown. The tab is formed of the same or similar material as the tab depicted in FIG. 2 and is of single-piece flat planar construction. The tab 90 includes an upper display portion 91 and a lower anchor portion 92. The upper display portion 91 has a straight upper longitudinal edge 93 and the lower anchor portion 92 has a substantially straight lower longitudinal edge 94. Longitudinally extending slots 95 extend inwardly towards each other at a location intermediate the longitudinal edge 93 and the longitudinal edge 94. Slots 95 are disposed in aligned relation and the slots define the lower longitudinal edge 96 of the display portion and the upper longitudinal edge of the anchor portion. The upper display portion is provided with downwardly diverging transverse edges while the lower anchor portion is provided with upper diverging transverse edges 99. It will be noted that the transverse edges on the anchor portions cooperate with the slot defining longitudinal edges to define anchor elements for facilitating insertion into the slits 85 of FIG. 8. It is again pointed out that the tab illustrated in FIG. 9 is especially adapted for use with the folder illustrated in FIG. 8. The tab illustrated in FIG. 2 is adapted for use with the embodiment of FIGS. 1–7.

From the foregoing, it will be seen that a deliver/presentation folder may be readily converted into a conventional file folder by merely shifting the identifying tab from an out-of-the-way position to a display position. It will further be noted that the tabs for the folders do not become damaged and shabby during shipping, handling and presentations because the tabs are located within the folders and are not moved to the display position until the folder is converted into a conventional file folder. The convertability of the deliver/presentation folder enhances the possibility that regular or prospective customers of companies who provide such folders will file the convertible folder as a file folder and retain the contents thereof. Companies who provide deliver/presentation folders will be able to customize their folders by simply customizing the tab and using a generic folder that contains the tab holding slot.

Thus it will be seen that I have provided a novel convertible folder which functions in a more efficient manner than any heretofore known comparable folder.

What is claimed is:

1. A convertible folder for readily converting a delivery/presentation folder to a filing folder, comprising, a pair of similar, rectangular flat folder panels interconnected to each other along a fold line and having longitudinal and transverse edges, a generally rectangular pocket defining panel connected to a transverse edge of a folder panel along a fold line and folded against the folder panel, a pair of slots in the pocket defining panel adjacent an edge thereof, a rectangular tab supporting panel secured to an edge of one of the folder or pocket defining panels, and folded against the associated defining panel, means securing the tab supporting panel and folded pocket defining panel against a folder panel, the pocket defining panel forming a pocket with a folder panel, an identifying tab including a display portion and an anchor portion, means on the anchor portion engaging in the slots of the pocket defining panel to secure the tab to the folder, said tab being readily moveable between a display position projecting beyond a longitudinal edge of a folder panel and an out-of-the-way position wherein the tab is positioned within the confines of the folder.

2. The convertible folder as defined in claim 1 wherein the tab is removed and reinserted in the slots of the pocket defining panel when shifted between the display and out-of-the-way positions.

3. A convertible folder for readily converting a delivery/presentation folder to a filing folder, comprising, a pair of similar, rectangular flat folder panels interconnected to each other along a fold line, and having longitudinal and transverse edges, a generally rectangular pocket defining panel connected to a transverse edge of a folder panel along a fold line and folded against the folder panel, a pair of slots in the pocket defining panel adjacent an edge thereof, a rectangular tab supporting panel secured to an edge of the pocket defining panel and folded against the pocket defining panel, means securing the tab supporting panel and folded pocket defining panel against a folder panel, the pocket defining panel forming a pocket with a folder panel, an identifying tab including a display portion and an anchor portion, means on the anchor portion engaging in the slots of the pocket defining panel to secure the tab to the folder, said tab being readily moveable between a display position projecting beyond a longitudinal edge of a folder panel, and an out-of-the-way position wherein the tab is positioned within the confines of the folder.

4. The convertible folder as defined in claim 3 wherein the tab is slidable relative to the pocket defining panel between the display and out-of-the-way position.

5. A convertible folder for readily converting a delivery/presentation folder to a filing folder, comprising, a pair of similar, rectangular flat folder panels interconnected to each other along a fold line, and having longitudinal and transverse edges, a generally rectangular pocket defining panel connected to a transverse edge of a folder panel along a fold line and folded against the folder panel, a pair of slots in the pocket defining panel adjacent an edge thereof, an elongate rectangular tab supporting panel secured to a longitudinal edge of a folder panel along a fold line, and folded against the connected folder panel, said tab supporting panel having a plurality of spaced apart pairs of slots therein, means securing the tab supporting panel and folded pocket defining panel against a folder panel, the pocket defining panel forming a pocket with a folder panel, an identifying tab including a display portion and an anchor portion, means on the anchor portion engaging in selected slots of the tab supporting or pocket defining panels to secure the tab to the folder, said tab being readily moveable between a display position projecting beyond a longitudinal edge of a folder panel, and an out-of-the-way position wherein the tab is positioned within the confines of the folder.

* * * * *